US008998152B2

(12) United States Patent
Daniel et al.

(10) Patent No.: US 8,998,152 B2
(45) Date of Patent: Apr. 7, 2015

(54) PORTABLE BARRIER INSTALLATION SYSTEM AND RELEASE MECHANISM

(75) Inventors: Barton Wade Daniel, Kennesaw, GA (US); Timothy Charles Stamps, Carl Junction, MO (US)

(73) Assignee: Landmark Earth Solutions, Inc., Carthage, MO (US)

( * ) Notice: Subject to any disclaimer, the term of this patent is extended or adjusted under 35 U.S.C. 154(b) by 218 days.

(21) Appl. No.: 13/480,951

(22) Filed: May 25, 2012

(65) Prior Publication Data

US 2013/0312873 A1 Nov. 28, 2013

(51) Int. Cl.

| | |
|---|---|
| ***B65B 67/04*** | (2006.01) |
| ***B65B 1/06*** | (2006.01) |
| ***B65B 67/12*** | (2006.01) |
| ***E02B 3/10*** | (2006.01) |
| ***E02B 3/12*** | (2006.01) |

(52) U.S. Cl.

CPC ..... *B65B 67/1227* (2013.01); *B65B 1/06* (2013.01); *E02B 3/108* (2013.01); *E02B 3/127* (2013.01)

(58) Field of Classification Search

CPC .... B65B 39/00; B65B 67/12; B65B 67/1227; B65F 1/141; B65F 1/1415

USPC ..... 248/94, 95, 97, 99, 100; 141/231, 340, 141/390, 391

See application file for complete search history.

(56) References Cited

U.S. PATENT DOCUMENTS

| | | | | |
|---|---|---|---|---|
| 1,402,227 | A * | 1/1922 | Gilbert | 248/100 |
| 1,862,413 | A * | 6/1932 | Malicay | 248/98 |
| 1,994,980 | A * | 3/1935 | Cook | 248/97 |
| 2,172,529 | A * | 9/1939 | Barker et al. | 248/97 |
| 4,139,029 | A * | 2/1979 | Geraci | 141/98 |
| 4,749,158 | A * | 6/1988 | Buckley | 248/98 |
| 5,031,277 | A * | 7/1991 | Coker | 15/257.3 |
| 5,048,778 | A * | 9/1991 | Wright | 248/98 |
| 5,323,990 | A * | 6/1994 | Graves | 248/97 |
| 6,082,574 | A * | 7/2000 | Johnson | 220/495.1 |
| 6,116,548 | A * | 9/2000 | Oleson | 248/97 |
| 8,479,780 | B2 * | 7/2013 | Fernandez et al. | 141/10 |

* cited by examiner

*Primary Examiner* — Anita M King

(74) *Attorney, Agent, or Firm* — Shook, Hardy & Bacon L.L.P.

(57) ABSTRACT

A portable barrier installation system and release mechanism is provided. A support frame comprising a first support arch is coupled on each end to a first and second support base. A second support arch, parallel to the first support arch, is coupled on each end to the first and second support base. A hopper assembly is coupled to the support frame. Rotation of the hopper assembly causes the hopper assembly to be in a fill or storage position. A release mechanism facilitates the release and placement of filled bags.

18 Claims, 4 Drawing Sheets

PORTABLE BARRIER INSTALLATION SYSTEM AND RELEASE MECHANISM

BACKGROUND

The present invention generally relates to a portable barrier installation system and release mechanism. More particularly, the invention relates to a lightweight, fully portable, rapid installation barrier system for transfer of granular material into bags for forming barriers and a release mechanism to quickly release the barrier bags so additional bags can be filled.

Generally, during flooding conditions, erosion protection, construction and mining applications, military and peacekeeping uses, time is of the essence. As such, manual sandbag filling techniques may result in catastrophic losses since they are time consuming and generally, very physically demanding. Some semi-automated sandbagging systems exist which may speed the process but they generally require manual handling of the sandbags once they are filled in order to form the barrier. The weight of the sandbags makes this a very difficult task.

Other systems utilize trailers to fill and place the sandbags; however, these systems require a hitch on the trailer and the constant availability of a truck, tractor, or other pulling machine to move the trailer each time a bag is filled and placed before another bag can be filled. In difficult-to-reach or inaccessible areas, rough terrain, military applications, or similar situations, this can be problematic.

Accordingly, a need exists for a lightweight and fully portable barrier installation system with a release mechanism that can be assembled at location and easily moved by one or more workers, without requiring a truck, tractor, or other pulling machine.

BRIEF SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention relate to a portable barrier installation system and release mechanism. In one embodiment, the portable barrier installation system comprises a hopper assembly coupled to a support frame. The hopper assembly comprises one or more hopper sheets coupled to one or more hopper arms. The one or more hopper sheets include a bag attachment section for receiving a plurality of bag hangers. The portable barrier installation system further comprises a release mechanism coupled at opposite ends to one of the one or more hopper arms and the support frame. The release mechanism is adapted to selectively lock the hopper sheets in an extended position.

In another embodiment, the release mechanism comprises a hopper arm lock coupled to a hopper brace mount. The hopper brace mount is coupled to a support frame. Pivoting the hopper arm lock into a fully extended position causes a hopper assembly to rotate to an open position for receiving fill material into a bag.

In another embodiment, the portable barrier installation system comprises a support frame. The support frame comprises a first support arch coupled on each end to a first support base and a second support base. The support frame further comprises a second support arch, parallel to the first support arch, coupled on each end to the first support base and the second support base. The portable barrier installation system further comprises a hopper assembly coupled to the support frame. The hopper assembly comprises one or more hopper sheets coupled to one or more hopper arms and pivotably coupled to a crossbar passing through the one or more hopper arms. The crossbar is coupled on each end to the support frame, such that rotation of the hopper assembly with respect to the crossbar causes the hopper assembly to be in a fill or storage position.

These and other aspects of the invention will become apparent to one of ordinary skill in the art upon a reading of the following description, drawings, and the claims.

DETAILED DESCRIPTION

Figure 1:
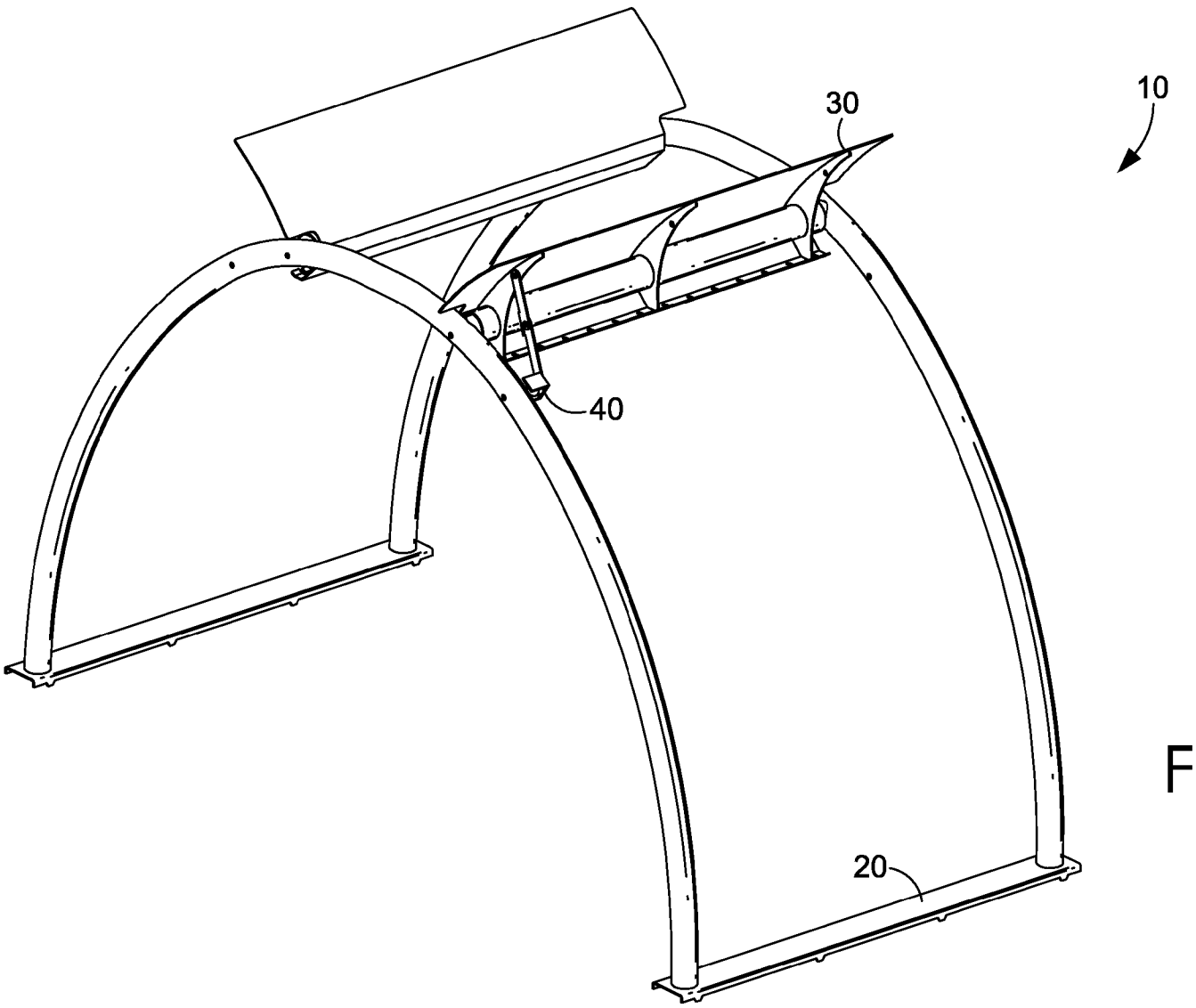
FIG. 1 is a perspective view of a portable barrier installation system in accordance with an embodiment of the present invention.

Referring to the drawings, and particularly to FIG. 1, a perspective view of a portable barrier installation system 10 is illustrated in accordance with an embodiment of the present invention. The portable barrier installation system 10 includes a support frame 20, a hopper assembly 30, and a release mechanism 40. In one embodiment, the portable barrier installation system 10 is constructed out of a fabricated, lightweight material. In one embodiment, the portable barrier installation system 10 is made out of aluminum. In all embodiments, the portable barrier installation system 10, can be disassembled and reassembled quickly and easily in the field. Further, the portable barrier installation system 10 is easily moved and placed, without the use of a truck, a tractor, or a pulling machine. Rather the entire portable barrier installation system 10 is fully movable, particularly when a bag attached to the portable barrier installation system 10 is either not filled or after the bag has been released by the portable barrier installation system 10, with one or more persons. Simply put, the portable barrier installation system 10, even in a fully assembled state, is easily lifted and placed into position by one or more persons picking up and moving the portable barrier installation system 10.

Figure 2:
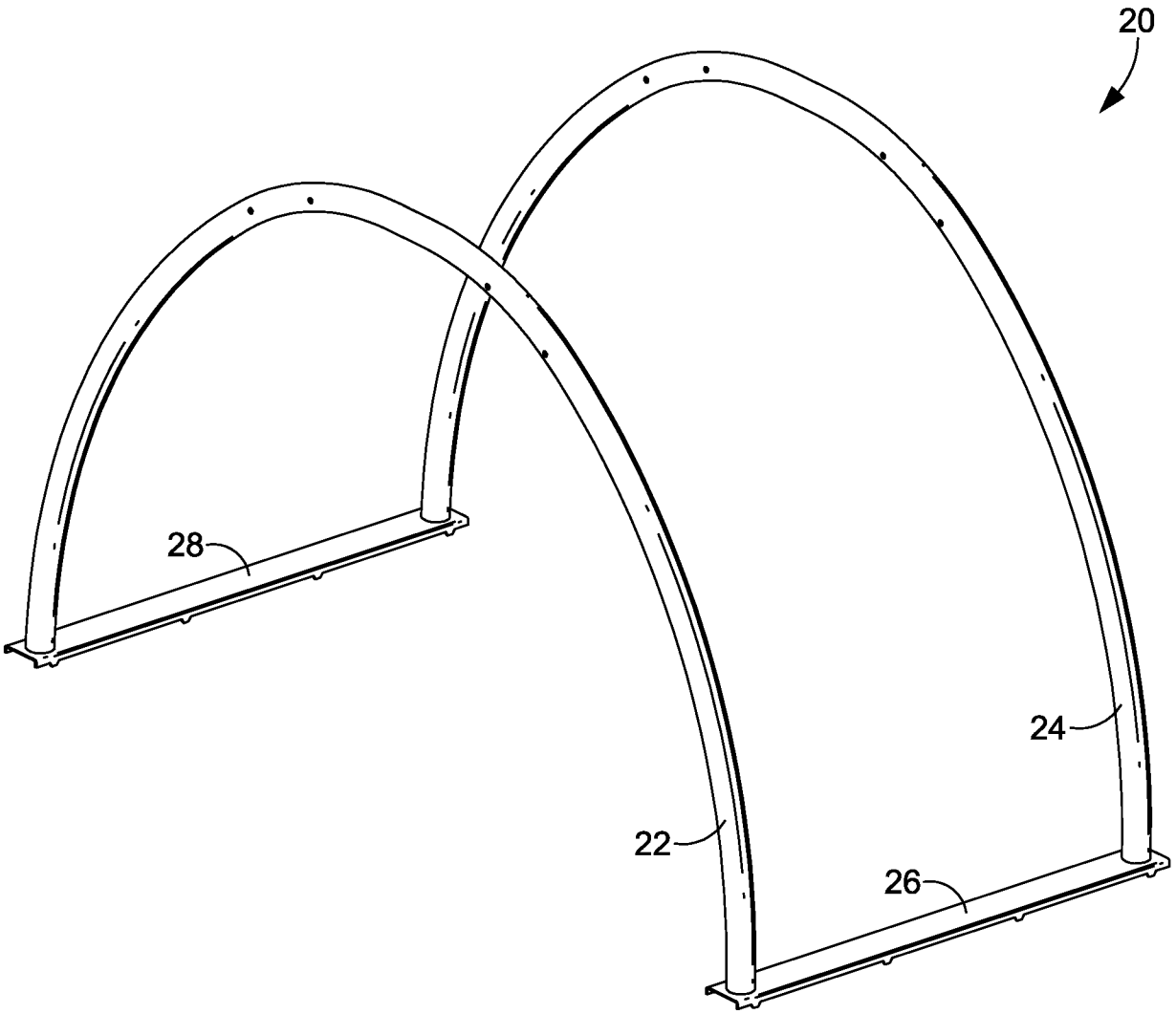
FIG. 2 is a perspective view of a support frame in accordance with an embodiment of the present invention.

Referring now to FIG. 2, a perspective view of a support frame 20 is illustrated in accordance with an embodiment of the present invention. In one embodiment, the support frame 20 is a fabricated, lightweight frame. In one embodiment, the support frame comprises a first support arch 22, a second support arch 24, a first support base 26, and a second support base 28. The first support arch 22 is coupled on each end to the first support base 26 and the second support base 28. The second support arch 24 is parallel, or substantially parallel, to the first support arch 22 and is coupled on each end to the first support base 26 and the second support base 28. In one embodiment, the support frame is any shape that adequately supports the load of a filled bag.

As mentioned previously, the portable barrier installation system 10 can be disassembled and reassembled quickly and in the field. Accordingly, in one embodiment, the support frame 20 is also able to be disassembled and reassembled quickly and in the field. For example, the hopper assembly 30 and release mechanism 40 shown in FIG. 1 can be uncoupled from the support frame 20. Once removed, each of the first and second support bases 26, 28 can be uncoupled from the first and second support arches 22, 24. Further, once uncoupled from the first and second support bases 26, 28, each of the first and second support arches 22, 24 are designed to be broken down into a series of interconnecting tubes. Such assembly and disassembly allows the portable barrier installation system 10 to reach remote areas or areas with rough terrain that cannot be reached by traditional barrier systems that utilize a trailer and require a truck, tractor, or pulling machine to move and place the trailer. The portable barrier installation system 10 is also more easily used in military applications where a slow-moving trailer might be an easy target. Further, in erosion control applications, a system utilizing a heavy trailer might cause even more damage. In another embodiment, the one or more hopper sheets 32 of the hopper assembly 30 are nested onto the first and second support arches 22, 24 when in a released position, allowing for more convenient storage without completely disassembling the portable barrier installation system 10.

Figure 3:
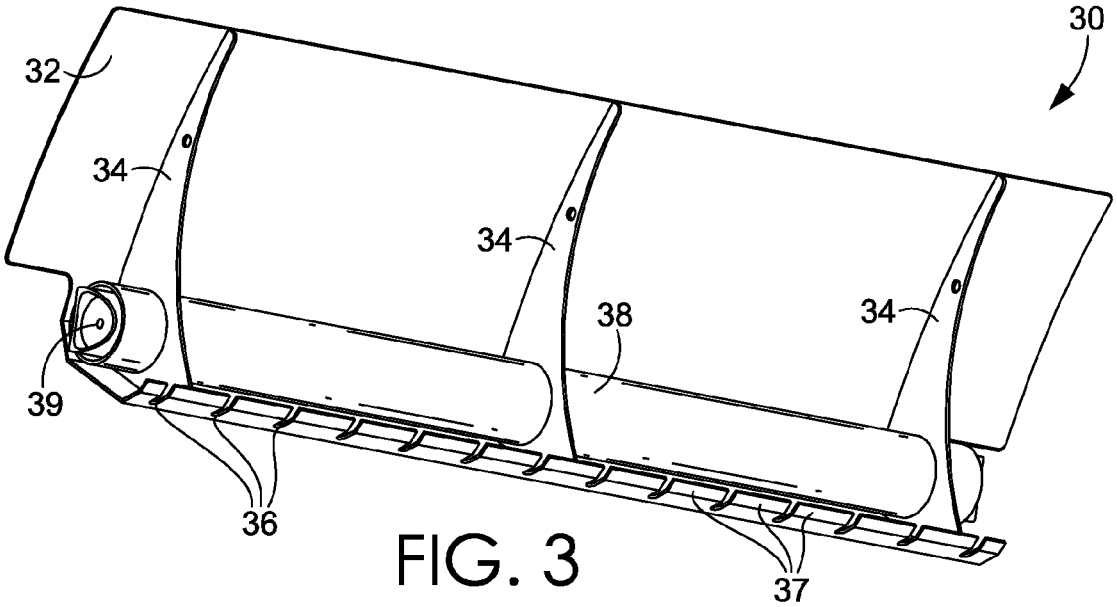
FIG. 3 is a perspective view of one side of a hopper assembly in accordance with an embodiment of the present invention.

Referring now to FIG. 3, a perspective view of one side of a hopper assembly 30 is illustrated in accordance with an embodiment of the present invention. It should be understood that in use, a pair of hopper assemblies 30 are used that are substantially mirror images of one another. For simplicity, only one hopper assembly 30 is described here. In one embodiment, the hopper assembly 30 comprises one or more hopper sheets 32 coupled to one or more hopper arms 34. The one or more hopper sheets 32 include slots 36 for receiving a bag (not shown in FIG. 3). As seen in FIG. 3, at the open end of each slot 36 is an upturned tab 37, the importance of which is further described herein. In one embodiment, the hopper assembly 30 is pivotably coupled to a crossbar 38 passing through the one or more hopper arms 34. The crossbar 38 is coupled on each end to the support frame 20. In one embodiment, a crossbar insert 39 facilitates coupling the crossbar 38 to the support frame 20.

In one embodiment, the one or more hopper sheets is a fabricated lightweight sheet material with slots 36 on one end to receive a plurality of bag hangers. In one embodiment, the one or more hopper sheets 32 are angled at the slots 36 to support the plurality of bag hangers. The angle facilitates opening the bag sufficiently to receive the fill material. In one embodiment, the plurality of bag hangers are pin-like attachments to the bag. In one embodiment, the plurality of bag hangers are reinforced loops of material attached to the bag.

In one embodiment, the one or more hopper sheets 32 direct fill material into the bag. The hopper sheets 32 act as a hopper and the position of the bag relative to the hopper protects the side walls of the bag from being directly hit with fill material.

Figure 4:
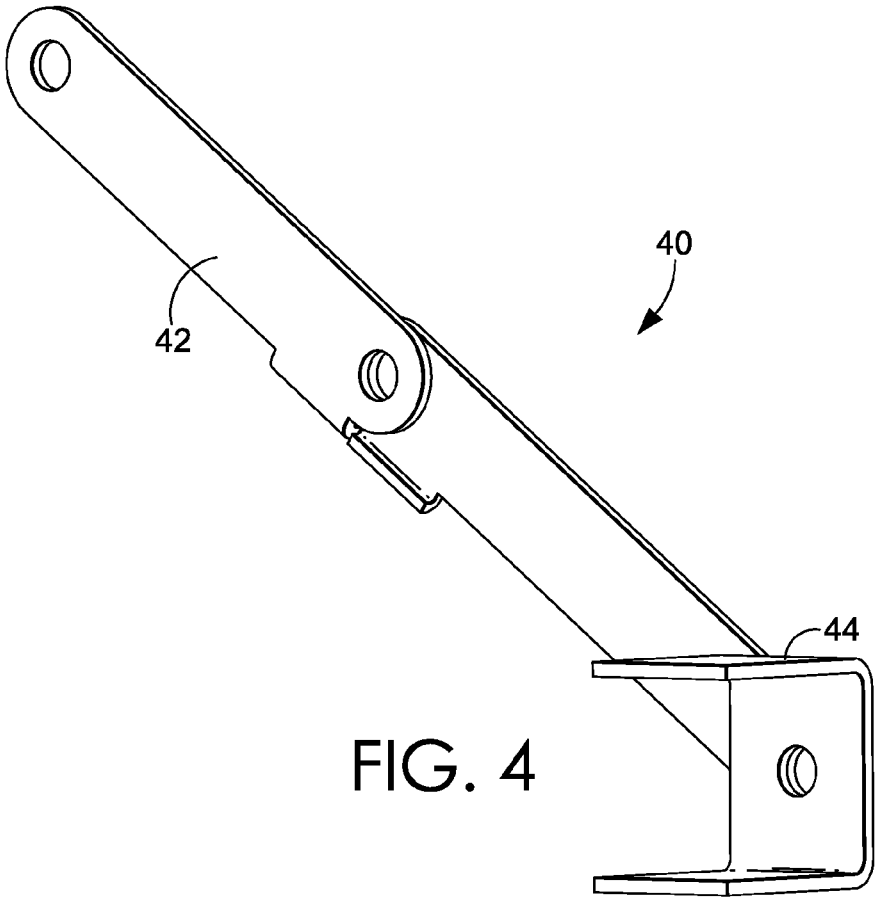
FIG. 4 is a perspective view of a release mechanism in accordance with an embodiment of the present invention.

Referring now to FIG. 4, a perspective view of a release mechanism 40 is illustrated in accordance with an embodiment of the present invention. In one embodiment, the release mechanism 40 is coupled at opposite ends to one of the one or more hopper arms 32 and the support frame 20. The release mechanism 40 comprises a hopper arm lock 42 coupled to a hopper brace mount 44. In one embodiment, the hopper arm lock 42 is a knuckle joint. The hopper brace mount 44 is coupled to the support frame 20. In one embodiment, the hopper brace mount 44 is contoured such that it nests against the first and second support arches 22, 24. In one embodiment, the hopper brace mount 44 is designed to prevent slippage or movement of the release mechanism with respect to its coupled position on the support frame. As can be appreciated, the hopper brace mount 44 can be any number of shapes, materials, or structures to accomplish such design. In one embodiment, the release mechanism 40 is an over-top-dead center mechanism. In one embodiment, the release mechanism 40 is internally housed or contained within a housing (not shown in FIG. 4).

In one embodiment, pivoting the hopper arm lock 42 into a fully extended position causes the hopper assembly 30 to rotate in an open position for receiving fill material into a bag. In one embodiment, pivoting the hopper arm lock 42 into a broken position causes the hopper assembly 30 to rotate to a closed position for releasing the bag received by the hopper assembly 30. As the hopper assembly 30 rotates, the slots 36 for receiving the plurality of bag hangers drop down and rotate from under the plurality of bag hangers to release the bag. In one embodiment, rotating the hopper assembly 30 into a fill or locked position causes the hopper arm lock 32 to extend to extend into a locked position. Consequently, the hopper assembly 30 holds the bag in an open position to receive fill material.

After the bags are filled, or substantially filled, the release mechanism and the plurality of bag hangers are under a considerable load. As a result, manual release of the bags is not safe or practical. To relieve the downward force and disengage the plurality of bag hangers, in one embodiment, the hopper arm lock 42 is articulated into a broken position causing the hopper assembly 30 to rotate around a crossbar 38 and release the plurality of bag hangers from the one or more hopper sheets 32, releasing the bag. In another embodiment, rotating the hopper assembly 30 into a released position causes the slots 36 to drop down and rotate from under the plurality of bag hangers to release the bag.

Figure 5:
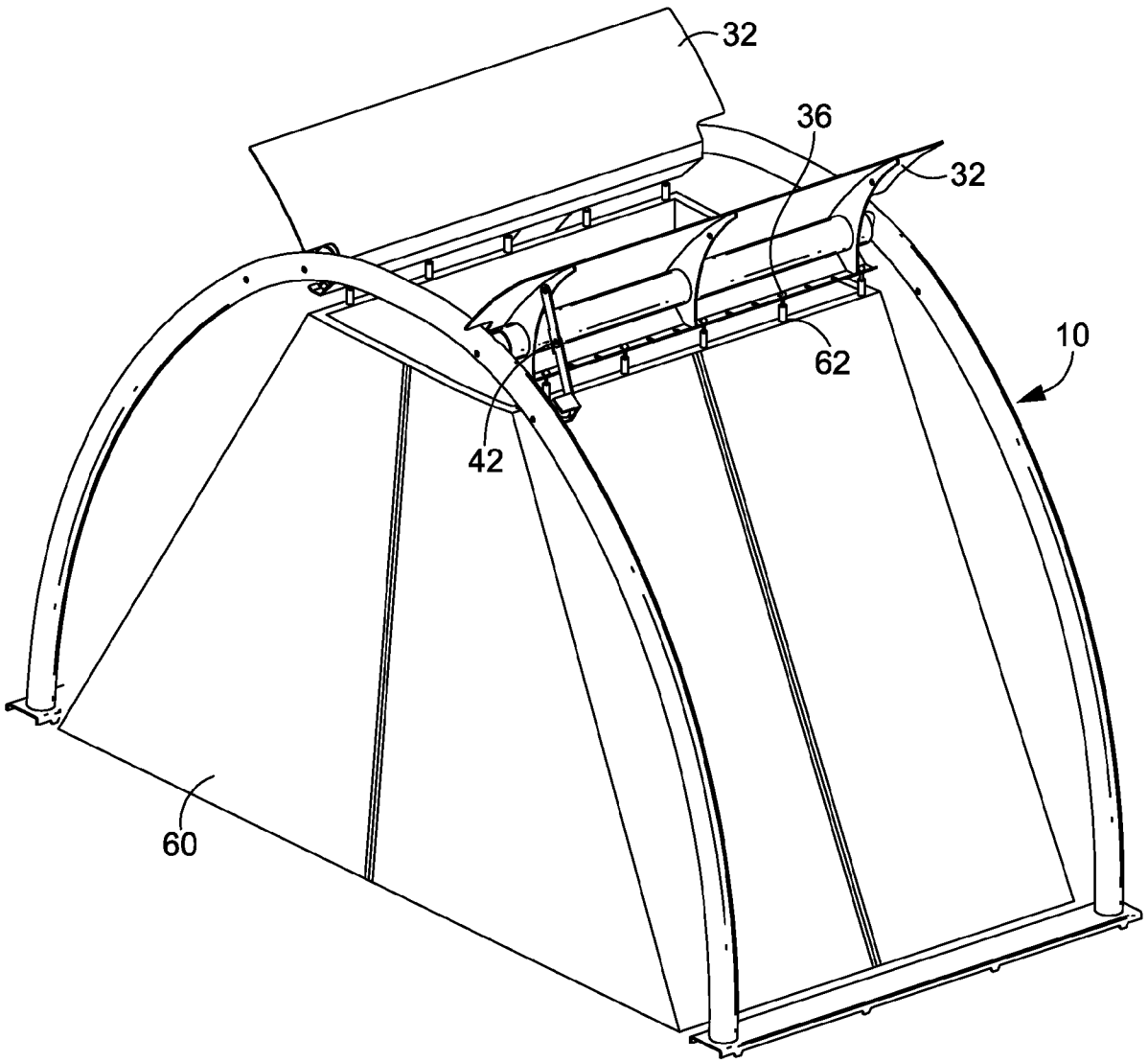
FIG. 5 is a perspective view of a portable barrier installation system in accordance with an embodiment of the present invention.

In practice, and referring now to FIG. 5, a perspective view of a portable barrier installation system 10 is illustrated in accordance with an embodiment of the present invention. After the portable barrier installation system 10 is assembled and placed, a bag 60 is positioned inside the support frame 20. In one embodiment, a plurality of bag hangers 62 coupled to the bag 60 are placed into or received by the slots 36 of the hopper assembly 30. The hopper sheets 32 are then rotated upward into an open position, and the slots 36 and tabs 37 cooperate with the plurality of bag hangers 62 to support the open condition of the bag 60.

Once the hopper sheets 32 are fully rotated, the release mechanism 40 is in a locked position. In one embodiment, a knuckle joint acts as the hopper arm lock 42 and is in a fully extended or locked position when the hopper sheets 32 are fully rotated upward. The plurality of bag hangers 62 of the bag 60 are lifted and rotated outward by the slots 36 as the hopper sheets 32 are rotated upward. This outward rotation of the plurality of bag hangers 62 causes the bag 60 to open. The bag 60 is then ready to receive fill material. As noted previously, the hopper sheets 32 acts as a hopper to guide the fill material into the bag 60. In addition and as illustrated by FIG. 5, the hopper sheets 32 also protect the side walls of the bag 60 from being directly hit with fill material.

As the bag 60 is filled with fill material, a considerable load is placed on the plurality of bag hangers 62. To release the load, the slots 36 are rotated out from under the plurality of bag hangers 62. In one embodiment, the knuckle joint of the hopper arm lock 42 is collapsed or broken causing the hopper sheets 32 to rotate downward into a storage position. As the hopper sheets 32 rotate downward, the slots 36 drop down and rotate from under the plurality of hangers 62, releasing and placing the bag 60 into position. In another embodiment, the release mechanism is contained in a housing.

Once the bag 60 is filled, the release mechanism is actuated into a release position and the slots 36 drop down and rotate from under the plurality of hangers 62, releasing and placing the bag 60 into position. Once the bag 60 is released, the portable barrier installation system 10 can be easily moved to the next desired location, and the process can be repeated.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method.

It will be understood that certain features and subcombinations are of utility and may be employed without reference to other features and subcombinations. This is contemplated by and is within the scope of the claims.

The invention claimed is:

1. A portable barrier installation system, comprising:

a support frame;

a hopper assembly coupled to the support frame, the hopper assembly comprising one or more hopper sheets coupled to one or more hopper arms, the one or more hopper sheets including a bag attachment section for receiving a plurality of bag hangers; and a release mechanism coupled at opposite ends to one of the one or more hopper arms and the support frame, the release mechanism adapted to selectively lock the hopper sheets in an extended position, wherein the support frame comprises first and second support members, wherein the first support member is coupled to a first side of the hopper assembly, wherein the second support member is coupled to a second side of the hopper assembly, the second side of the hopper assembly positioned opposite the first side of the hopper assembly.

2. The portable barrier installation system of claim 1, wherein the bag attachment section includes slots.

3. The portable barrier installation system of claim 1, wherein the support frame comprises a first support base and a second support base, wherein the first support member is coupled on each end to the first support base and the second support base, and wherein the second support member is coupled on each end to the first support base and the second support base.

4. The portable barrier installation system of claim 1, wherein the hopper assembly is pivotably coupled to a crossbar passing through the one or more hopper arms, the crossbar coupled on each end to the support frame, such that rotation of the hopper assembly with respect to the crossbar causes the hopper assembly to be in a locked or released position.

5. The portable barrier installation system of claim 1, wherein the one or more hopper sheets is a fabricated lightweight sheet material with slots on one end to receive a plurality of bag hangers.

6. The portable barrier installation system of claim 4, wherein the one or more hopper sheets are angled at the slots to support the plurality of bag hangers.

7. The portable barrier installation system of claim 4, wherein rotating the hopper assembly into a fill position causes a hopper arm lock to extend into a locked position and the hopper assembly to hold the bag in an open position to receive fill material.

8. The portable barrier installation system of claim 1, wherein articulating an arm lock into a broken position causes the hopper assembly to rotate around a crossbar and release a plurality of bag hangers from the one or more hopper sheets, releasing the bag.

9. The portable barrier installation system of claim 4, wherein rotating the hopper assembly into a released position causes the slots to drop down and rotate from under the plurality of bag hangers to release the bag.

10. The portable barrier installation system of claim 4, wherein the release mechanism comprises a hopper arm lock coupled to a hopper brace mount.

11. The portable barrier installation system of claim 1, wherein the release mechanism is an over-top-dead center mechanism.

12. The portable barrier installation system of claim 1, wherein the one or more hopper sheets direct fill material into the bag.

13. The portable barrier installation system of claim 1, wherein the release mechanism is contained within a housing.

14. A release mechanism for a portable barrier installation system, comprising:

a hopper arm lock coupled to a hopper brace mount; and the hopper brace mount coupled to a support frame, wherein pivoting the hopper arm lock into a fully extended position causes a hopper assembly to rotate to an open position for receiving fill material into a bag, and wherein pivoting the hopper arm lock into a broken position causes the hopper assembly to rotate around a crossbar for releasing a bag received by the hopper assembly, wherein the release mechanism is contained within a housing.

15. A portable barrier installation system, comprising: a support frame comprising:

a first support arch coupled on each end to a first support base and a second support base; and a second support arch, parallel to the first support arch, coupled on each end to the first support base and the second support base; and a hopper assembly coupled to the support frame, the hopper assembly comprising one or more hopper sheets coupled to one or more hopper arms and pivotably coupled to a crossbar passing through the one or more hopper arms, the crossbar coupled on each end to the support frame, such that rotation of the hopper assembly with respect to the crossbar causes the hopper assembly to be in a fill or storage position.

16. The portable barrier installation system of claim 15, further comprising a release mechanism contained within a housing and coupled at opposite ends to one of the one or more hopper arms and the support frame.

17. The portable barrier installation system of claim 16, wherein the release mechanism comprises a hopper arm lock coupled to a hopper brace mount, the hopper brace mount coupled to the support frame.

18. The portable barrier installation system of claim 17, wherein pivoting the hopper arm lock into a fully extended position causes the hopper assembly to rotate to an open position for receiving fill material into a bag, and further wherein pivoting the hopper arm lock into a broken position causes the hopper assembly to rotate to a closed position for releasing a bag received by the hopper assembly.

* * * * *